US008217245B1

(12) United States Patent
McKenney

(10) Patent No.: US 8,217,245 B1
(45) Date of Patent: Jul. 10, 2012

(54) GUITAR

(76) Inventor: James R. McKenney, Wichita, KS (US)

( * ) Notice: Subject to any disclaimer, the term of this patent is extended or adjusted under 35 U.S.C. 154(b) by 134 days.

(21) Appl. No.: 12/789,204

(22) Filed: May 27, 2010

(51) Int. Cl.
*G10D 1/08* (2006.01)

(52) U.S. Cl. ..... 84/267; 84/291

(58) Field of Classification Search ..... 84/267, 84/292

See application file for complete search history.

(56) References Cited

U.S. PATENT DOCUMENTS

| | | | | | |
|---|---|---|---|---|---|
| 519,416 | A | | 5/1894 | Turner | |
| 1,489,710 | A | * | 4/1924 | Olsen | 84/295 |
| 3,561,314 | A | * | 2/1971 | MacEachron | 84/284 |
| 3,563,126 | A | | 2/1971 | Connington | |
| 3,774,492 | A | * | 11/1973 | Forbes | 84/170 |
| 4,206,678 | A | | 6/1980 | Guerrero | |
| 4,253,371 | A | | 3/1981 | Guice | |
| 4,320,685 | A | * | 3/1982 | Pytlewski | 84/291 |
| 4,411,186 | A | * | 10/1983 | Faivre | 84/291 |
| 4,572,049 | A | | 2/1986 | Tanaka et al. | |
| 4,873,909 | A | * | 10/1989 | Humphrey | 84/293 |
| 4,911,055 | A | | 3/1990 | Cipriani | |
| 5,260,505 | A | | 11/1993 | Kendall | |
| 5,325,756 | A | | 7/1994 | Sugden | |
| 5,481,955 | A | | 1/1996 | Goto | |
| 5,627,331 | A | * | 5/1997 | Devitrysmith | 84/304 |
| 5,895,872 | A | | 4/1999 | Chase | |
| 5,949,006 | A | * | 9/1999 | Hechler | 84/291 |
| 6,534,697 | B1 | | 3/2003 | Ko | |
| 6,603,066 | B2 | | 8/2003 | Rogers | |
| 7,161,075 | B2 | | 1/2007 | Tamura | |
| 7,462,767 | B1 | | 12/2008 | Swift | |
| 2008/0115651 | A1 | | 5/2008 | Schmidt | |

FOREIGN PATENT DOCUMENTS

| | | |
|---|---|---|
| WO | WO 97/01162 | 9/1997 |

* cited by examiner

*Primary Examiner* — David Warren
*Assistant Examiner* — Robert W Horn
(74) *Attorney, Agent, or Firm* — Kenneth H. Jack; Davis & Jack, L.L.C.

(57) ABSTRACT

A guitar including a sound box having a headward end and a tailward end, the sound box having a back, a sound board, and a side wall spanning between the back and the sound board, the back, the sound board, and the side wall each having inner and outer surfaces; a neck fixedly attached to and extending headwardly from the sound box's headward end, the neck having a distal end; a head stock fixedly attached to the neck's distal end; a bridge and saddle combination fixedly attached to the sound board; a channeled string anchoring block operatively positioned within the sound box and at the sound box's tailward end; and a sound hole opening the sound box, the sound hole being positioned between the bridge and saddle combination and the channeled string anchoring block.

15 Claims, 3 Drawing Sheets

GUITAR

FIELD OF THE INVENTION

This invention relates to guitars. More particularly, this invention relates to guitars having specialized adaptations for guitar string support, anchoring, and extension.

BACKGROUND OF THE INVENTION

The strings of a commonly configured guitar are typically anchored immediately behind the string saddle at the guitar's bridge. Where the guitar is a classical guitar, the strings are typically tied at that location, and where the guitar is a typical conventional guitar, the strings are commonly held at that location by string receiving slot and wedge peg combinations. Such common guitar string anchoring configuration undesirably applies a localized torsional or twisting force to the guitar's sound board at the locus of the guitar's string and saddle assembly. While applying such undesirable torsion to the guitar's sound board, any effective rearward or tailward extension of the strings for complimentary resonance with the headward extensions of the strings or for desirable strumming is eliminated. Additionally, such common guitar string anchoring configuration undesirably eliminates or nullifies the capacity of the strings to control or alter the guitar's tone and sound texture by applying a backwardly directed compressive force to the guitar's sound board.

The instant inventive guitar solves or ameliorates the problems, deficiencies, and drawbacks discussed above by repositioning a guitar's sound hole and by utilizing such repositioned sound hole as a through passage for an angled extension of the guitar's strings into the interior of the guitar's sound box for tailward anchoring therein.

BRIEF SUMMARY OF THE INVENTION

A first structural component of the instant inventive guitar comprises a hollow body or sound box. The sound box preferably comprises a wooden back, a frontal sound board, and a peripherally extending side wall which spans between the back and the sound board, the back, side, and sound board forming a sound reverberation and amplification space.

A further structural component of the instant inventive guitar comprises a neck which conventionally supports components including a string raising nut at the neck's distal or headward end, an enlarged attachment heal at the neck's tailward or proximal end, and a conventional fret board and frets which overlie the neck's frontal aspect. In a preferred embodiment, the neck's heal portion is fixedly attached by gluing or bolting to the headward end of the guitar's sound box.

A further structural component of the instant inventive guitar comprises a string mounting and tensioning head stock which is fixedly attached to the neck's headward or distal end. Preferably, the head stock supports peg heads, tuning keys, geared tuning machines, or tuners for securely mounting and variably tensioning the headward ends of the guitar's strings.

A further structural component of the instant inventive guitar comprises a bridge and saddle combination. In a preferred embodiment, the bridge comprises a rectangular wooden block or plate which is mounted upon the sound board's outer or frontal surface, the bridge functioning to translate vibrating or oscillating movements of the strings to the guitar's sound board. The saddle component of such combination is preferably fixedly attached to a frontal surface of the bridge for receiving and raising the guitar's strings over the sound board and over the neck's fret board.

A further structural component of the instant inventive guitar comprises string anchoring means which are connected operatively within the sound box and are positioned at the sound box's tailward end. In a preferred embodiment, the string anchoring means comprise a channeled block through which the strings may be threadedly extended. Suitably, the string anchoring means may alternatively comprise string receiving apertures or channels whose headward ends open at the inner and tailward surface of the sound box's side wall.

A further structural component of the instant inventive guitar comprises a specially positioned sound hole which opens the sound box and which is located between or is co-linear with the guitar's bridge and saddle combination and the guitar's tailwardly positioned string anchoring means.

Upon installation of guitar strings upon the instant inventive guitar, each of the guitar strings has a headward extension which is similar in configuration to the headward extensions of the strings of a conventional guitar. Unlike a conventional guitar, each mounted string of the instant inventive guitar has a second lengthened extension which spans between the bridge and saddle combination and the guitar's internal and tailwardly positioned string anchoring means. Upon operation of the string tuners at the head stock of the instant inventive guitar to apply to tension to the guitar's strings, an obtuse angle is advantageously defined between the strings' headward and tailward extensions. Such angular tensioning of the strings advantageously produces a backwardly directed force vector which is applied to the guitar's sound board for stressing and altering the tone, color, and texture of the sounds produced by the guitar. Additionally, upon such specialized string anchoring, the segments of the strings which extend tailwardly and backwardly through the guitar's sound hole are advantageously capable of vibrating or oscillating in complimentary resonance with the vibrations of the strings' headward extensions. Additionally, such tailward string extensions are amenable to a musician's plucking or strumming for additional guitar sound production.

Also in a preferred embodiment of the instant inventive guitar, the cross bracing which typically undergirds and supports the guitar's sound board is specially positioned so that an intersection or vertex of the bracing directly underlies the bridge. Such bracing position advantageously evenly distributes over the sound board the string's backwardly directed force, as described above.

Also in the preferred embodiment, the internal and tailwardly positioned string anchoring means are adapted for variably positioning the tailward attachments of the guitar's strings for selectively altering the force angle between the string's headward and tailward extensions, and for selectively altering the vibration length of the string's tailward extensions.

Accordingly, it is an object of the instant invention to provide a guitar which incorporates structures, as described above, and which arranges those structures with respect to each other above, in the manners described for performing and achieving the benefits and advantages described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
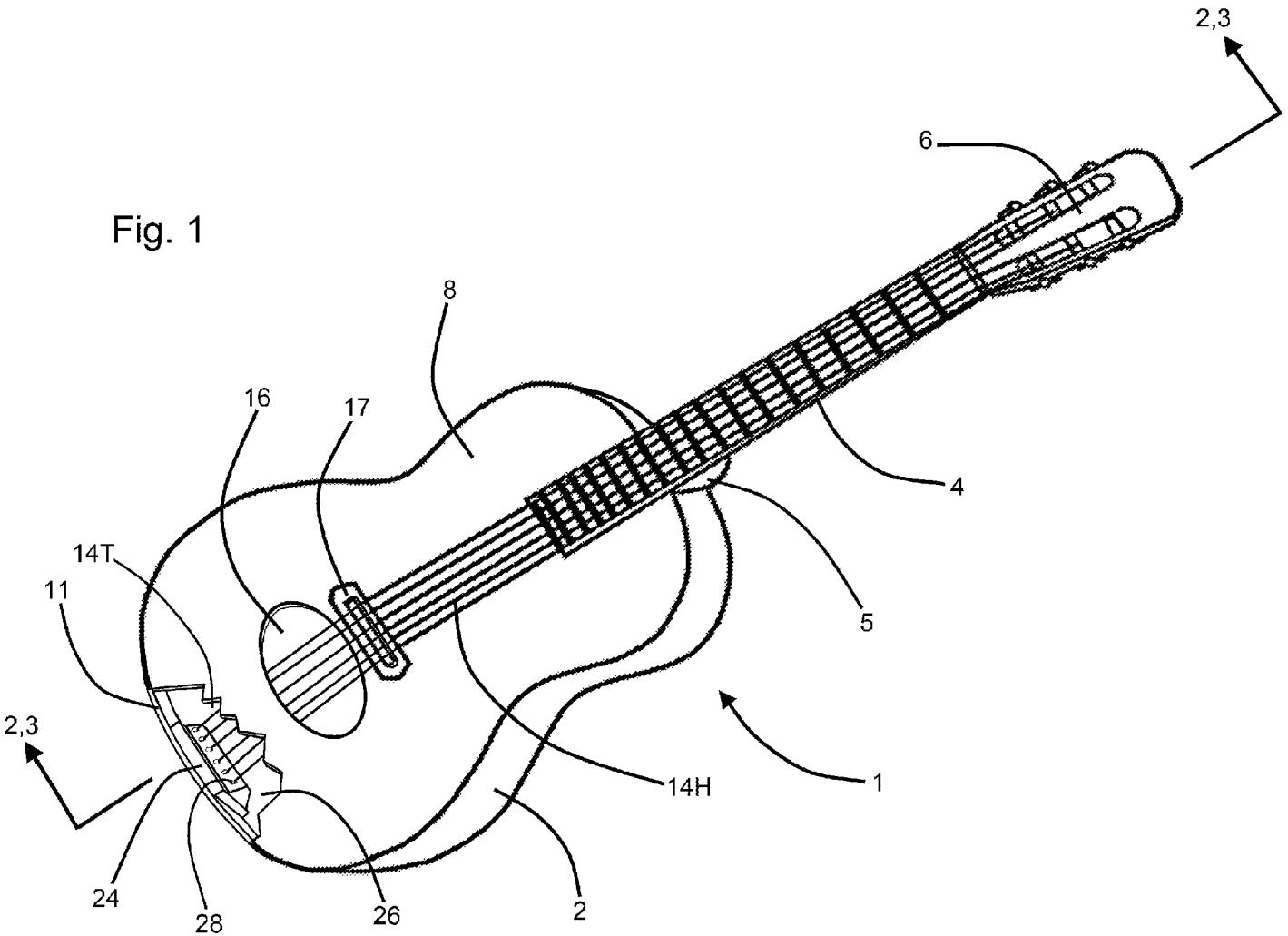
FIG. 1 is a perspective view of a preferred embodiment of the instant inventive guitar.
Figure 2:
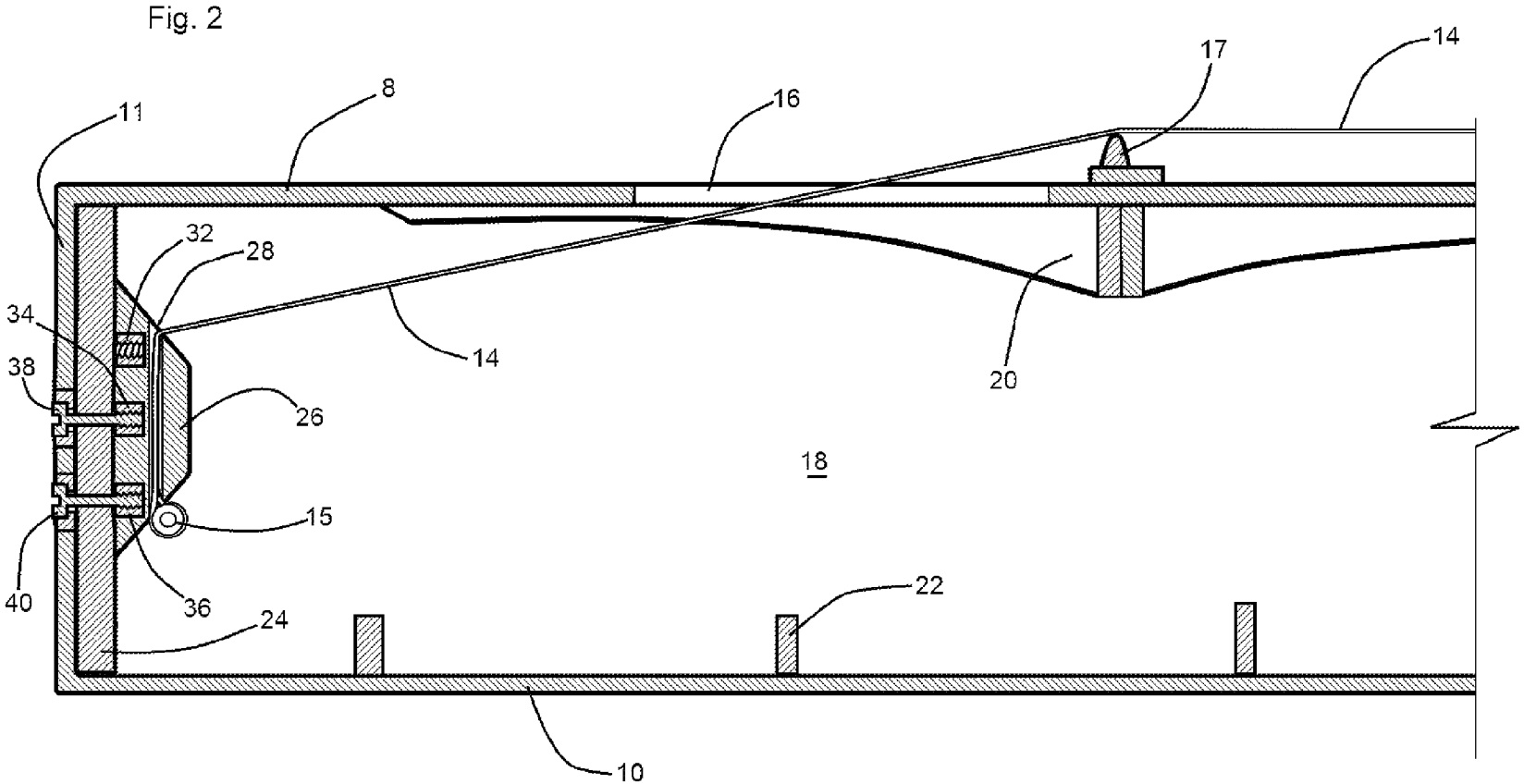
FIG. 2 is a sectional view as indicated in FIG. 1.

Referring now to the drawings, and in particular to FIGS. 1 and 2, a preferred embodiment of the instant inventive guitar is referred to generally by Reference Arrow 1. The guitar 1 has a body or sound box which defines a hollow interior sound reverberation and amplification space 18. The back end of the hollow interior space 18 is bounded by a back 10, and such space is frontwardly bounded by a top or sound board 8. The reverberation space 18 is peripherally bounded by a side wall 11, such wall spanning between and rigidly interconnecting the back 10 and the sound board 8. Cross bracing 22 lends rigidity to the back 10.

The guitar 1 has a conventional neck 4 which has a frontal surface supporting a fret board and frets. The proximal end of the neck 4 is enlarged to form a heel 5 which is fixedly and rigidly attached to the headward end of the sound box. A head stock 6 which supports string attaching and tensioning tuning pegs, pins, or geared toners is fixedly attached to the neck's distal or headward end.

Referring simultaneously to FIGS. 1 and 2, means for securely anchoring the tailward ends of guitar strings 14T, 14H are preferably provided, such means preferably being adapted for attaching the strings at a location within the sound box's interior space 18, and at the tailward end of such space. Such means preferably comprises an anchor block 26 which has a plurality of string receiving and capturing channels 28 extending vertically there through. The number of such channels 28 preferably corresponds with the number of strings 14T,14H.

Referring further simultaneously to FIGS. 1 and 2, a structurally reinforcing tail block 24 is preferably fixedly mounted to the inner surface of the side wall 11 at the tailward end of the sound box, and the string anchor block 26 is preferably fixedly and repositionably mounted upon the headward surface of the tail block 24 by means of helically threaded screws 38 and 40. In operation, such screws may selectively engage pairs of helically threaded sockets, 32 and 34 or 34 and 36 for adjustments of the effective lengths and angular extensions of the tailward extensions of strings 14T,14H. As is shown in FIG. 2, the anchor block 26 may be frontwardly positioned via threaded engagement of screws 38 and 40 with the frontward pair of sockets 34 and 36. Alternatively, referring further to FIG. 3, the anchor block 26 may repositioned in the backward direction by re-engagement of screws 38 and 40, with the backward socket pair, 32 and 34. The functional significance of such repositioning capability of the string anchor block 26 is further discussed below.

Referring further simultaneously to FIGS. 1 and 2, a sound hole 16 preferably positioned at and extends through the sound board 8. Such sound hole is preferably specially positioned tailwardly from the guitar's string elevating and vibration transmitting bridge and saddle combination 17. Such specially positioned hole advantageously performs multiple functions including facilitating frontward passage of sound waves, facilitating tailward and backward extensions of the tailward portions 14T of the guitar strings, and facilitating passage of a user's hand into the guitar's hollow interior 18 for attachment of the tailward ends of such strings upon the anchor block 26.

Referring further to FIGS. 1 and 2, in order to achieve such interior and tailward anchoring of the strings 14T,14H, a guitarist may initially grasp the extreme tailward end of one of a loose guitar string, and the guitarist may manually carry and move such string in the backward direction through sound hole 16 and into the interior space 18. Thereafter, the guitarist may further carry such string end within the sound box in the tailward direction until such string end underlies and aligns with the back end of one of the channels 28 within anchor block 26. Thereafter, the guitarist may frontwardly thread such string end through such channel 28, and may regrasp such string end upon its emergence from the opposite frontward end of such channel 28. Thereafter, the guitarist may draw and pull such string end frontwardly and headwardly through the interior space 18, and thence outwardly through the sound hole 16, such drawing action continuing until the enlarged nut or eye 15 which is typically present at the extreme tailward end of the guitar strings wedges and stops against the backward opening of the channel 26. Such string extending, threading, and drawing steps may be repeated for each of six guitar strings, as depicted, causing the tailward ends of all six strings to become securely anchored within the interior space 18 and upon the anchor block 26. Thereafter, the opposite headward ends of the six strings may be engaged with the tuning pegs of the head stock 6, and such strings may be tightened and tuned.

Referring further simultaneously to FIGS. 1 and 2, it may be seen that upon tightening of the guitar strings 14T,14H, consistent obtuse angles are formed between the strings' tailward extensions 14T and their headward extensions 14H. Such angular orientations of the tailward extensions of the strings 14T with respect to their headward extensions 14H advantageously applies a backwardly directed driving force to the saddle and bridge 17 and to the sound board 8. Such string angle generated pressure advantageously stresses the sound board 8 for modification of the tone, texture, and color character of sound produced by the guitar.

In a preferred embodiment, the sound board 8 is undergirded or supported by a cross brace 20 which is preferably positioned so that its intersection or vertex directly underlies the saddle and brace 17. Such underlying alignment of the cross brace 20 advantageously evenly disperses the backwardly directed pressure applied by strings 14T,14H over the sound board 8 for enhancement of control of sound tone, color, and texture.

Figure 3:
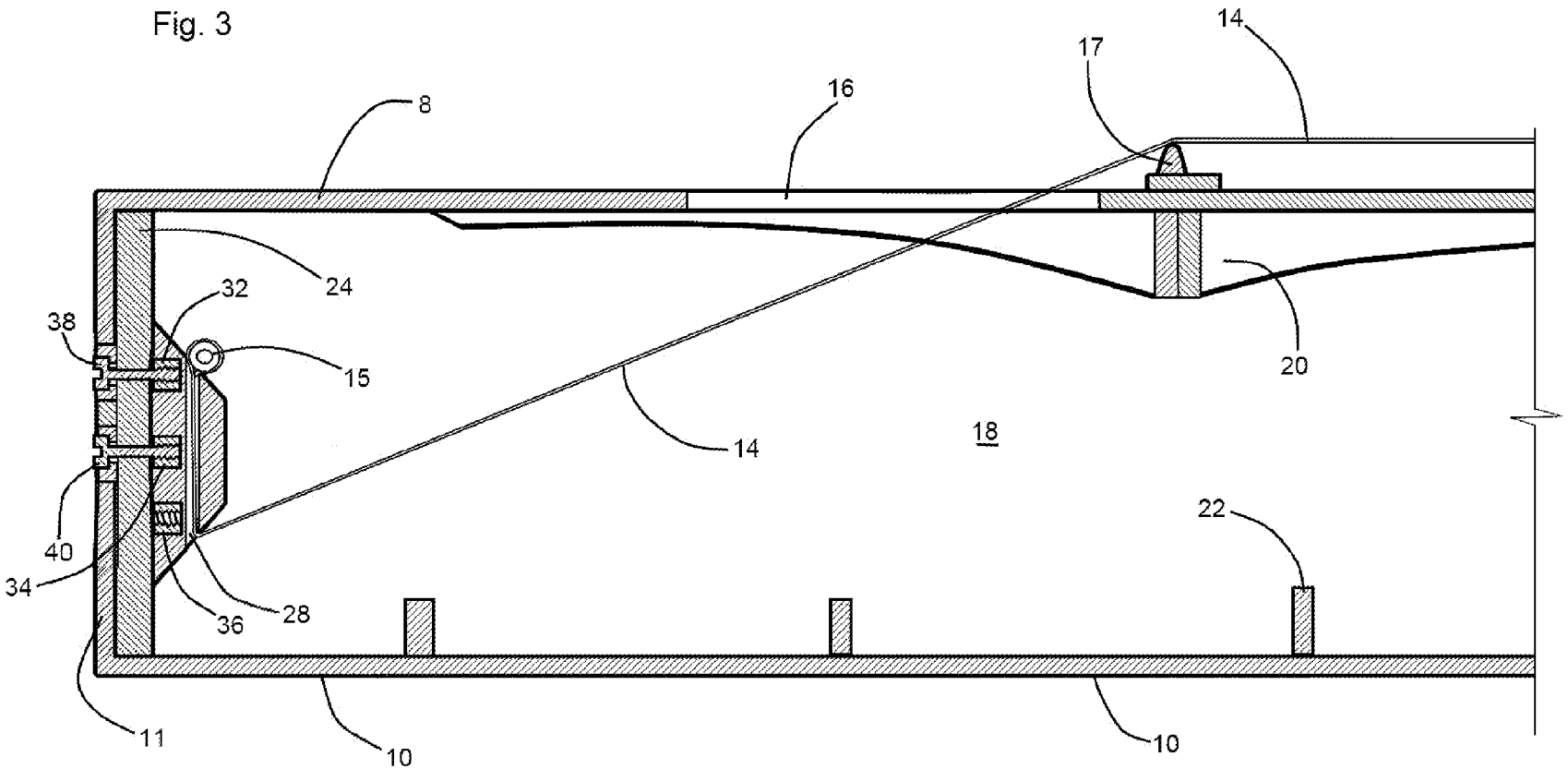
FIG. 3 redepicts FIG. 2, the view of FIG. 3 showing an alternative string anchoring configuration.

Referring simultaneously to FIGS. 2 and 3, it may be seen that the strings 14T,14H may alternatively be attached to the anchor block 26 so that the headward end of each string is backwardly threaded there through, as depicted in FIG. 3, rather than forwardly threaded, as depicted in FIG. 2. Such alternative backward threading of the strings advantageously makes less obtuse the angle between the tailward and headward extensions 14T and 14H of the strings, and commensurately increases the backwardly directed force applied by such strings to the saddle and bridge plate 17, and to the sound board 8. Such alternative string installation advantageously alters the tone, color, and sound texture of the guitar. Further string angle adjustments, and resultant adjustments of the guitar's tone, color, and sound texture, may be accomplished by selectively frontwardly and backwardly positioning and repositioning the anchor block 26 by, as described above, by alternatively engaging screws 38 and 40 with the frontward socket pair 32 and 34, and the backward socket pair 34 and 36.

The depicted combination of the channeled string anchor block 26, screws 38 and 40, and sockets 32, 34, and 36 is representative of numerous other suitable mechanical means for variably and repositionably anchoring the guitar's tailward string extensions 14T. In one simple example, a matrix of string receiving apertures (not depicted) may be provided at the tailward end of the guitar's side wall.

It may be noted that the tailward string extensions 14T have lengths which are capable of movement in complimentary or harmonic resonance with the primary vibrations of strings' headward extensions 14H, and such tailward extensions are further amenable to being plucked or strummed by the guitarist. The above described selective alteration of string angles for adjustment of string pressure applied to the sound board 8, may advantageously dually or additionally function for selective adjustment of the effective vibrating length of the string sections 14T. Accordingly, adjustments of string anchor position within the guitar 1 multiply function for sound board pressure adjustment, for alteration of the resonance length of the tailward string segments 14T, and for adjustment of the tone or pitch produced by such string segments upon plucking or strumming.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A guitar comprising:

(a) sound box having a headward end and a tailward end, the sound box comprising a back, a sound board, and a side wall spanning between the back and the sound board, the back, the sound board, and the side wall each having inner and outer surfaces;

(b) a neck fixedly attached to and extending headwardly from the sound box's headward end, the neck having a distal end;

(c) a head stock fixedly attached to the neck's distal end;

(d) a bridge and saddle combination fixedly attached to the sound board;

(e) string anchoring means operatively positioned within the sound box upon the side wall's inner surface and at the sound box's tailward end; and (f) a sound hole, the sound hole opening the sound box, and the sound hole being positioned between the bridge and saddle combination and the string anchoring means.

2. The guitar of claim 1 wherein the sound hole is further positioned at the sound box's sound board.

3. The guitar of claim 2 wherein the sound hole is further positioned tailwardly from the bridge and saddle combination.

4. The guitar of claim 3 wherein the sound hole is fitted for hand passage.

5. The guitar of claim 1 wherein the string anchoring means is adapted for selective frontward and backward positioning and repositioning of guitar strings.

6. The guitar of claim 1, further comprising a plurality of strings, each string among the plurality of strings having a headward extension from the bridge and saddle combination, and a tailward extension from the bridge and saddle combination, the sound hole being positioned for receiving the strings' tailward extensions.

7. The guitar of claim 6 wherein the sound hole is fitted for hand passage.

8. The guitar of claim 7 wherein the sound hole is positioned tailwardly from the bridge and saddle combination.

9. The guitar of claim 8 wherein the string anchoring means is adapted for selectively frontwardly and backwardly positioning and repositioning of the guitar strings.

10. A guitar comprising:

(a) sound box having a headward end and a tailward end, the sound box comprising a back, a sound board, and a side wall spanning between the back and the sound board, the back, the sound board, and the side wall each having inner and outer surfaces;

(b) a neck fixedly attached to and extending headwardly from the sound box's headward end, the neck having a distal end;

(c) a head stock fixedly attached to the neck's distal end;

(d) a bridge and saddle combination fixedly attached to the sound board;

(e) string anchoring means adapted for selective frontward and backward positioning and repositioning of guitar strings, the string anchoring means being operatively positioned within the sound box and at the sound box's tailward end; and (f) a sound hole, the sound hole opening the sound box, and the sound hole being positioned between the bridge and saddle combination and the string anchoring means, the string anchoring means comprising a channeled block.

11. The guitar of claim 10 wherein the adaptation for selective frontward and backward positioning and repositioning of guitar strings comprises screw and threaded socket combinations.

12. A guitar comprising:

(a) sound box having a headward end and a tailward end, the sound box comprising a back, a sound board, and a side wall spanning between the back and the sound board, the back, the sound board, and the side wall each having inner and outer surfaces;

(b) a neck fixedly attached to and extending headwardly from the sound box's headward end, the neck having a distal end;

(c) a head stock fixedly attached to the neck's distal end;

(d) a bridge and saddle combination fixedly attached to the sound board;

(e) string anchoring means operatively positioned within the sound box and at the sound box's tailward end; and (f) a sound hole, the sound hole opening the sound box, and the sound hole being positioned between the bridge and saddle combination and the string anchoring means; and (g) a cross brace supporting the sound board's inner surface, the cross brace having a vertex, the cross brace's vertex substantially underlying the bridge and saddle combination.

13. A guitar comprising:

(a) a sound box having headward and tailward ends, the sound box having a back, a sound board, and a side wall, the side wall spanning between the back and the sound board;

(b) a neck fixedly attached to and extending headwardly from the sound box's headward end, the neck having a distal end;

(c) a head stock fixedly attached to the neck's distal end;

(d) a bridge and saddle combination fixedly attached to the sound board;

(e) a plurality of strings, each string among the plurality of strings having a headward extension from the bridge and saddle combination, and a tailward extension from the bridge and saddle combination;

(f) a sound hole opening the sound box at the sound board, and the sound hole being positioned for receiving the strings' tailward extensions, the sound hole being fitted for hand passage, the sound hole being positioned tailwardly from the bridge and saddle combination; and (g) string anchoring means connected operatively at the sound box's tailward end, the string anchoring means being adapted for selectively frontwardly and backwardly positioning and repositioning of the guitar strings, the adaptation for frontwardly and backwardly positioning and repositioning the guitar strings comprising a channeled block.

14. The guitar of claim 13 wherein the adaptation for selective frontward and backward positioning and repositioning of the guitar strings further comprises screw and threaded socket combinations.

15. The guitar of claim 14 further comprising a cross brace supporting the sound board's inner surface, the cross brace having a vertex, the cross brace's vertex substantially underlying the bridge and saddle combination.

* * * * *